United States Patent [19]

Donaldson et al.

[11] 4,366,860

[45] Jan. 4, 1983

[54] DOWNHOLE STEAM INJECTOR

[75] Inventors: A. Burl Donaldson; Donald E. Hoke, both of Albuquerque, N. Mex.

[73] Assignee: The United States of America as represented by the United States Department of Energy, Washington, D.C.

[21] Appl. No.: 269,460

[22] Filed: Jun. 3, 1981

[51] Int. Cl.[3] ..... E21B 36/02; E21B 43/24

[52] U.S. Cl. ..... 166/59; 166/63; 166/303; 431/158; 431/238; 431/243

[58] Field of Search ..... 431/158, 238, 243; 166/59, 63, 57, 303, 302, 256, 261; 175/14

[56] References Cited

U.S. PATENT DOCUMENTS

| | | | |
|---|---|---|---|
| 3,235,182 | 2/1966 | Ross et al. | 431/158 X |
| 3,385,381 | 5/1968 | Calaman | 431/158 X |
| 3,463,249 | 8/1969 | Browning et al. | 431/158 |
| 3,980,137 | 9/1976 | Gray | 166/303 |
| 3,982,591 | 9/1976 | Hamrick et al. | 166/59 X |
| 4,012,189 | 3/1977 | Vogt et al. | 431/158 X |
| 4,078,613 | 3/1978 | Hamrick et al. | 166/303 X |
| 4,156,421 | 5/1979 | Cradeur et al. | 166/303 X |

*Primary Examiner*—Stephen J. Novosad

*Attorney, Agent, or Firm*—Armand McMillan; George H. Libman; Richard G. Besha

[57] ABSTRACT

An improved downhole steam injector has an angled water orifice to swirl the water through the device for improved heat transfer before it is converted to steam. The injector also has a sloped diameter reduction in the steam chamber to throw water that collects along the side of the chamber during slant drilling into the flame for conversion to steam. In addition, the output of the flame chamber is beveled to reduce hot spots and increase efficiency, and the fuel-oxidant inputs are arranged to minimize coking.

10 Claims, 3 Drawing Figures

DOWNHOLE STEAM INJECTOR

The U.S. Government has rights in this invention pursuant to Contract No. DE-AC04-76DP00789 and modifications between the U.S. Department of Energy and Western Electric Company, Incorporated.

BACKGROUND OF THE INVENTION

The invention is in the area of tertiary oil recovery techniques, in particular, an improved apparatus for downhole generation of steam for injection into boreholes.

In the recovery of oil from earth formations, initially oil flow from many wells is driven by the pressure due to natural gases trapped along with the liquid oil in the formation. Pumping methods are employed when natural gas pressures decrease and become insufficient to drive oil to the surface. As the easily recoverable oil is removed pumping methods may be ineffective because the flow of the remaining oil out of porous underground formations into a well may be very slow. It is at this point that tertiary methods are sought to accelerate the flow of oil from the formation into the well.

A particularly useful tertiary method employs the injection of steam to heat the oil in the formation, thereby reducing its viscosity and increasing its flow rate into the well for recovery.

One downhole steam injector for use in tertiary oil recovery is applicants' co-pending patent application Ser. No. 195,966, filed Oct. 10, 1980. The discussion of other downhole steam injection patents included in this co-pending application is incorporated herein by reference.

A steam injector must operate reliably in the high temperature, high pressure environment existing several thousand feet down a borehole. Combustion should be non-coking (sootless) to prevent clogging earth formations that impede the flow of oil. Hot spots in the steam injector should be avoided to prevent material deterioration and failure in the downhole equipment. And water must mix thoroughly with the combustion to maximize steam output.

SUMMARY OF THE INVENTION

It is an object of this invention to provide a steam injector which completely mixes water with combustion products, even when the injector is operated at a 30° angle from the horizontal.

It is another object of this invention to provide a steam injector that provides thorough movement of cooling water, thereby minimizing hot spots.

It is also an object of this invention to provide a steam injector having a combustion chamber designed to minimize hot spots.

It is a further object of this invention to provide a steam injector having a non-coking combustion chamber.

Additional objects, advantages and novel features of the invention will be set forth in part in the description which follows and, in part, will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects and in accordance with the purpose of the invention, the steam injector of co-pending application Ser. No. 195,966 has been improved. The prior steam injector includes a top head, concentric spaced body, middle and inner sleeves contacting the top head at their top ends, a water channel extending from an orifice adjacent the bottom of the body, up the inner surface of the body and down the inner surface of the middle sleeve to an annular water injector fastened between the end of the inner sleeve and the inner surface of the middle sleeve. A bottom cap provides a water-tight seal between the outer inner surface of the body and the outer surface of the middle sleeve. The cooling of the injector is improved in this invention by making the axis of the water orifice in the body at an angle of 30 to 60 degrees with respect to a radius of the body in the plane perpendicular to the axis of the body, thereby creating a swirling motion for the water between the walls of the heat injector. Hot spots formed near the output of the water injector are eliminated in this invention by beveling the inner surface of the bottom end of the inner sleeve and water injector. Coking of the injector is reduced in this invention by an input arrangement for fuel and oxidant including a fuel orifice extending from the outer surface of the top head to an end at an inner location, an oxidant orifice extending from the outer surface to the inner surface and including a straight portion passing adjacent to the inner location and intersecting the inner surface, and a passage orifice connecting the inner location of the fuel orifice and the straight portion of the oxidant line. The axis of the passage orifice is normal to the axis of the straight portion, permitting fuel to spray into oxidant and mix completely. Water is completely mixed with combustion products in this invention by providing a truncated cone to reduce the diameter of the middle sleeve downstream of the water injector and upstream of the bottom cap, whereby water flowing under high pressure along the inner surface of the middle sleeve is thrown by the reducing cone into the middle of the flame.

Still other objects and advantages of the present invention will become readily apparent to those skilled in this art from the following detailed description, wherein we have shown and described only the preferred embodiment of the invention, simply by way of illustration of the best modes contemplated for carrying out the invention. As will be realized, the invention is capable of other and different embodiments, and its several details are capable of modification in various, obvious respects without departing from the invention. Accordingly, the drawings and description are to be regarded as illustrative in nature and not as restrictive.

BRIEF DESCRIPTION OF THE DRAWINGS

The accompanying drawings, which are incorporated in and form a part of the specification, illustrate an embodiment of the present invention and, together with the description, serve to explain the principals of the invention.

DETAILED DESCRIPTION OF THE INVENTION

Figure 1:
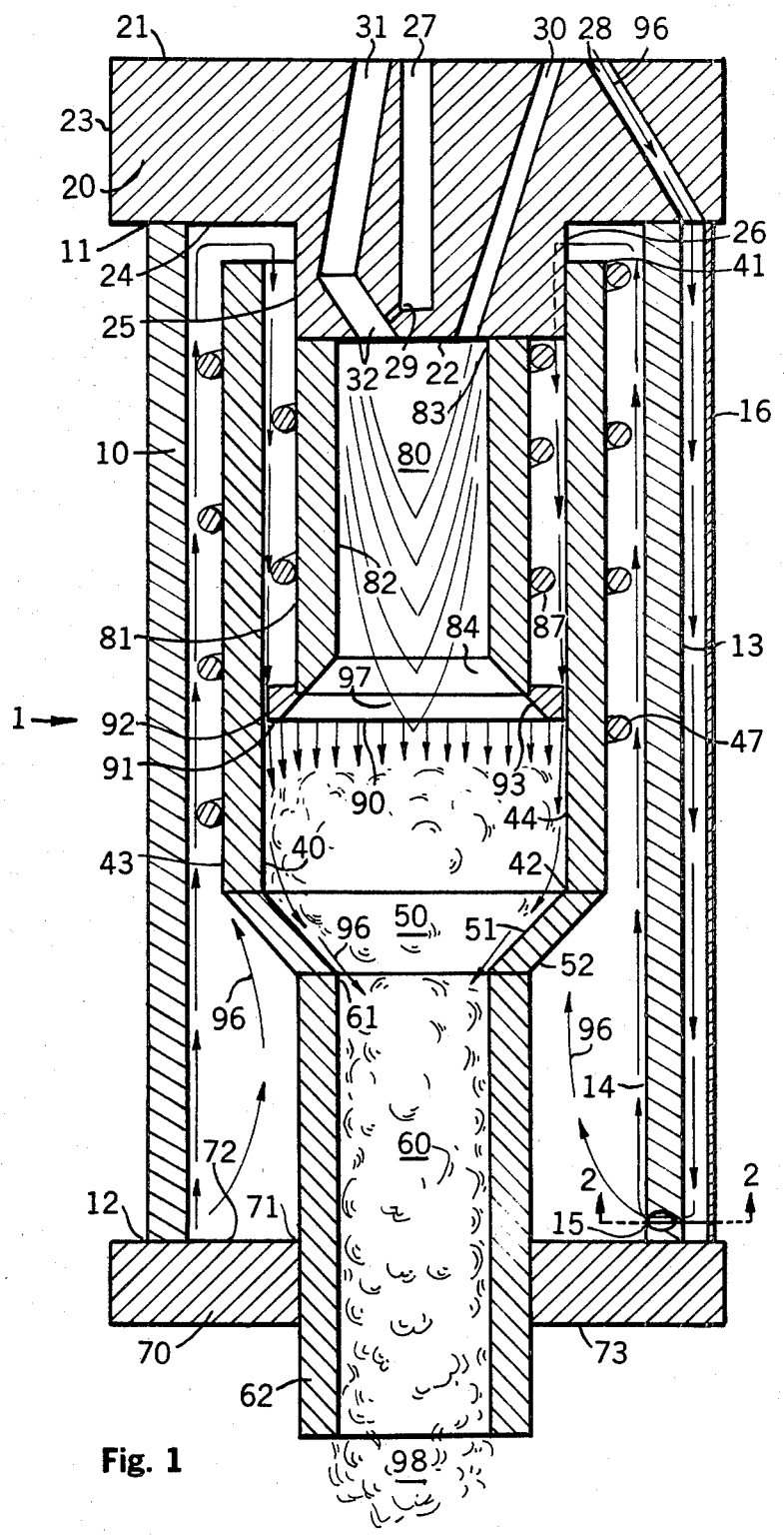
FIG. 1 shows a cutaway side view of a steam injector according to the invention.
Figure 3:
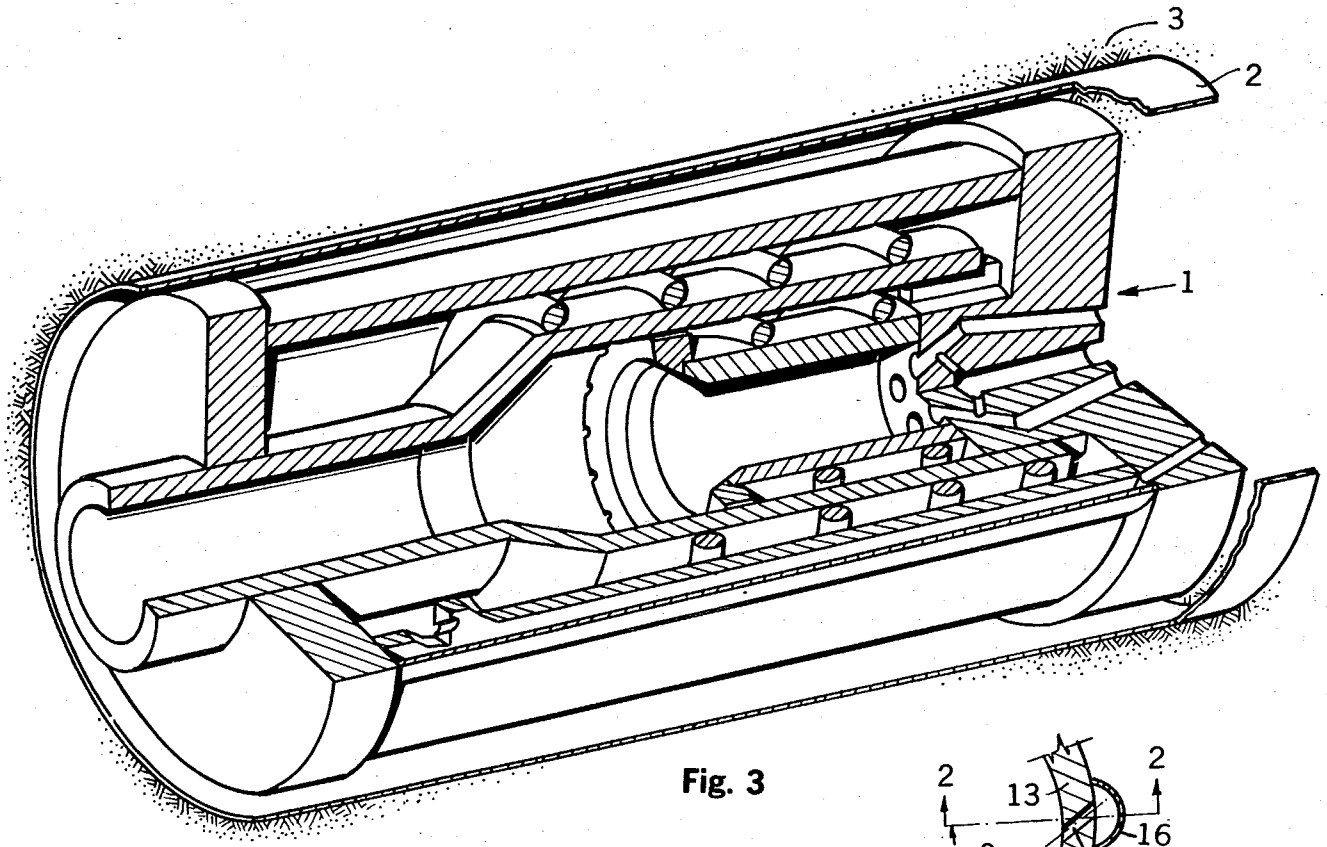
FIG. 3 is a partial cutaway of a steam injector in a slant borehole.

With reference to FIGS. 1 and 3, downhole steam injector 1 is attached to supply tubular (not shown) and placed in borehole 2 and oil-bearing ground 3. The exterior of steam injector 1 includes solid, cylindrical, top head 20, hollow cylindrical body 10 fastened at top end 11 to a shoulder portion 24 on the inner surface of top head 20 and fastened at bottom end 12 to an inner surface of solid cylindrical bottom end 70. The bottom end 62 of outlet pipe 60 extends through central orifice 71 in bottom end 70. Water tube 16 extends between the inner surface of top end 20 and the inner surface of bottom end 70.

As shown in FIG. 1, top head 20 includes outer end 21, first side portion 23, and an inner surface including shoulder portion 24, second side portion 26 and inner end 22. First side portion 23 has a diameter equal to bottom end 70 and greater than body 10 in order to protect body 10 from abrasion against the sides of borehole 2. Second side portion 25, which is concentric to and of reduced diameter from first side portion 23, includes a plurality of longitudinal tabs 26 extending radially outwardly.

Top head 20 also includes a plurality of orifices for the communication of fluid into the steam injector. These include fuel orifice 27 extending from outer surface 21 of top head 20 to an inner location near inner end 22, a water orifice 28 extending between outer end 21 and the top end of water tube 16, oxidant orifice 31 extending from outer surface 21 and including straight portion 32 which intersects inner end 22. The inner location of fuel orifice 27 is connected to straight portion 32 by passage orifice 29. Igniter orifice 30 extends from outer surface 21 to inner end 22.

Middle sleeve 40 is axially aligned with and spaced from body 10. In the preferred embodiment shown, inner surface 44 of middle sleeve 40 forms a tight, sliding fit over longitudinal tabs 26 of the second side portion of top head 20 to provide for thermal expansion of middle sleeve 40. Spiral wire spacer 47 is wound around and welded to the outer surface 43 of middle sleeve 40, thereby preventing the outer surface 43 of middle sleeve 40 from coming into contact with inner surface 14 of body 10 and providing high velocity water flow to discourage occurrence of hot spots.

Hollow cylindrical inner sleeve 80 is mounted to inner end 22, axially aligned with and spaced from middle sleeve 40. Inner sleeve 80 encloses the intersections of oxidant orifice 32 and igniter orifice 30 with inner end 22. Spiral wire 87 is wrapped around and welded to outer surface 81 of inne sleeve 80 to maintain the spacing from inner surface 44 of middle sleeve 40 and to increase turbulence of water flow as described below.

As shown in FIG. 1, body 10 is longer than middle sleeve 40 and middle sleeve 40 is longer than inner sleeve 80. An annular water injector 90 is attached to the bottom end of inner sleeve 80. The outer surface 91 of water injector 90 slides along inner surface 44 of middle sleeve 40 to provide for thermal expansion. Longitudinal water passages extend between opposed end surfaces of water injector 90. As shown in detail in co-pending patent application Ser. No. 195,966, water injector 90 includes a plurality of grooves 92 in outer surface 91 to provide the aforementioned water passage. In accordance with this invention, the inner surface 82 of inner sleeve 80 and the inner surface 93 of annular water injector 90 are beveled outwardly.

Bottom end 42 of middle sleeve 40 communicates with the exterior of steam injector 1 through an extended hollow portion. In a preferred embodiment, this portion includes reducer 50 and outlet pipe 60.

Reducer 50 is a truncated hollow cylindrical cone having a large end 51 of diameter equal to the diameter of the middle sleeve 40 and a small end 52 of diameter equal to the diameter of outlet tube 60. As shown in FIGS. 1 and 3, reducer 50 joins middle sleeve 40 to output tube 60 to form an exhaust port for gases generated by the steam injector.

Figure 2:
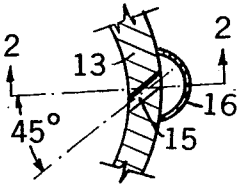
FIG. 2 is a lateral cross-section taken along lines 2—2 of FIG. 1.

As shown in FIG. 2, water tube 16 is a section of a small diameter pipe which is fastened along outer surface 13 of larger diameter body 10. Orifice 15 extends secantly through body 10 at a location adjacent bottom head 70 to permit water in tube 16 to flow into the steam injector. In accordance with a preferred embodiment of this invention, the axis of orifice 15 forms an angle of approximately 45° with a radius of body 10. This orientation insures that water enters body 10 with a swirling motion that maximizes water motion and its cooling ability. The magnitude of this angle is not too critical, although angles greater than 60° might weaken body 10 in the area of the orifice and angles less than 30° might not impart sufficient swirling motion to the water.

The operation of steam injector 1 is shown in FIG. 1. Water 96 is carried through a conduit in the supply tubular to orifice 28, through water pipe 16, through orifice 15 and into the chamber created by the outer surface of output pipe 60, reducer 50, and middle sleeve 40 and the inner surface 14 of body 10. The water is guided up this chamber by spiral spacer 47, and flows around top end 41 of middle sleeve 40 through the spaces between tabs 26 and top head 20. The water then swirls between outer surface 81 of inner sleeve 80 and inner surface 44 of middle sleeve 40 as guided by spiral spacer 87 until it sprays through holes 92 in annular water injector 90. Simultaneously, fuel such as crude or refined oil is provided through a conduit in supply tubular to orifice 27 and oxidant such as compressed air or gaseous oxygen is provided through a conduit in supply tubular to orifices 31 and 32. The fuel flows through passage orifice 29 and intersects the oxidant flow at right angles thereto, forming a mixture which burns without soot when ignited by a glow plug or similar device in igniting orifice 30. The flame 97 generated within inner sleeve 80 heats the water spraying past annular water injector 90 to form steam 98 which is ejected through outlet pipe 60.

It has been found that by beveling the bottom end 84 of inner sleeve 80, dead spots that formed around the annular water injector of the previous device are eliminated and a better conversion of water to steam is obtained.

It has also been found that a steam injector without a reducing portion does not function as well in a slant drilling application as it does in a vertical drilling application. FIG. 3 shows steam injector 10 at a angle of approximately 40° from the horizontal in a slant drilled hole. In this orientation, water is pulled by gravity along the downhole side of inner surface 44 of middle sleeve 40. Should middle sleeve 44 continue at the same diameter as outlet pipe 60, the water cooled along this surface would not mix completely with the flame and, therefore, would not be converted into steam. However, the inner surface of reducer 50 serves as a ramp which guides the water flowing along the lower side of middle sleeve 40 into the middle of the combustion chamber where the flame will quickly convert it into steam.

At a typical operating depth of 2500 feet (400 meters), a pressure of approximately 1300 (91 $Kg/cm^2$) psi is being exerted on steam injector 1, and water, fuel and oxygen are supplied at pressures of 1400 (98), 1500 (105) and 1310 (92) psi ($Kg/cm^2$) respectively.

The particular equipment discussed above is cited merely to illustrate a particular embodiment of this invention. It is contemplated that other arrangements may also be used that accomplish the same results. For instance, the inner surface of top head 20 could be continuous similar to outer surface 21. In this case, body 10, middle sleeve 40 and inner sleeve 80 would abut the inner end surface and water passages would be provided either through top head 20 around the top end 41 of the middle sleeve or, alternatively through the top end of middle sleeve 40.

In addition, water tube 16 may be a length of pipe of circular cross-section that connects to orifice 28 as shown or, if the borehole is of large diameter as compared with the diameter of steam injector 1, may continue as a separate water conduit to the surface. Also, water orifice 15 could be any means for the passage of water such as an orifice provided through bottom end 70 rather than through body 10.

In a preferred embodiment of the invention a steam injector 1 was constructed of welded stainless steel. Two opposed water tubes 16 are utilized to provide a more uniform water input through two opposed water orifices 15. In addition, four oxidant orifices 31 and 32 for oxygen are spaced around fuel orifice 27, with passage orifices 29 extending from fuel orifice 29 to each oxidant orifice. The approximate dimensions of a steam injector configured for combustion of air and diesel fuel are as follows: length 45" (1.1 m), diameter 5" (13 cm), length of inner sleeve 18" (46 cm), thickness of inner sleeve, length of middle sleeve 30.75" (78 cm), spacing between body and middle sleeve 16" (4 mm), spacing between middle sleeve and inner sleeve 0.11" (3 mm), inner diameter of middle sleeve 2.9" (7.4 cm) and inner diameter of outlet pipe 1.94" (5 cm). This unit is designed for use in a 7 inch (17.8 cm) borehole.

As long as the principles of this invention are followed, the steam injector so constructed will provide a reliable, and effective way of generating steam downhole. It is intended that the scope of the invention be defined by the claims appended hereto.

We claim:

1. A downhole steam injector comprising:

a solid cylindrical top head having separate orifices extending from an outer surface through the head for oxidant and fuel;

a hollow cylindrical body fastened at a top end to said top head;

orifice means for the passage of water from an outer surface to an inner surface of said body at a location adjacent the bottom end of said body;

a hollow cylindrical middle sleeve supported at a top end by said top head, said sleeve being axially aligned with and spaced from said body;

means at said top head for the passage of water from the outer to the inner surface of said middle sleeve;

a hollow cylindrical inner sleeve fastened at a top end to said top head, said inner sleeve being axially aligned with and spaced from said middle sleeve;

an annular water injector fastened at the bottom end of said inner sleeve and having an outer surface contiguous with an inside surface of said middle sleeve, said injector having longitudinal water passages extending between opposed end surfaces;

a reducer axially aligned with said sleeves comprising a hollow truncated cone having a large top diameter fastened to the bottom end of said middle sleeve and a small bottom diameter;

a cylindrical outlet pipe axially aligned with said sleeves having a top end fastened to the small end of said reducer sleeve;

and a cylindrical bottom head providing a water tight seal between the bottom end of said body and the outer surface of said outlet pipe.

2. The downhole steam injector of claim 1 wherein said top head has opposed outer and inner end surfaces, said fuel orifice extends from said outer surface to an end at an inner location, said oxidant orifice extends from said outer end surface to said inner surface and includes a straight portion passing adjacent the inner location and intersecting said inner end surface, and a passage orifice extends between the inner location of said fuel orifice and the straight portion of said oxidant orifice, the axis of said passage orifice being normal to the axis of the straight portion.

3. The downhole steam injector of claim 1 wherein the inner surface of the bottom end of said inner sleeve and an inner surface of said annular water injector are beveled.

4. The downhole steam injector of claim 1 wherein said orifice means extends through said body, the axis of said orifice forming an angle within the range of 30 to 60 degrees with a radius of said body.

5. A downhole steam injector comprising:

a solid cylindrical top head having separate orifices extending from an outer surface through the head for oxidant and fuel;

a hollow cylindrical body fastened at one end to said top head, said body having a water orifice extending from an outer surface to an inner surface at a location adjacent the other end, the axis of said orifice being in a plane perpendicular to the axis of said body and forming an angle within the range of 30 to 60 degrees with a radius of said body;

a hollow cylindrical middle sleeve supported at one end by said top head, said middle sleeve being axially aligned with and spaced from said body;

means at said top head for the passage of water from the outer to the inner surface of said middle sleeve;

a hollow cylindrical inner sleeve fastened at one end to said top head, said inner sleeve being axially aligned with and spaced from said middle sleeve;

an annular water injector fastened at the other end of said inner sleeve and having an outer surface contiguous with an inside surface of said middle sleeve, said injector having longitudinal water passages extending between opposed end surfaces;

an elongated hollow structure axially aligned with said sleeves extending from the other end of said middle sleeve;

a cylindrical bottom head extending from the other end of said body to the outer surface of said hollow structure.

6. The downhole steam injector of claim 5 wherein the angle of said axis is approximately 45 degrees.

7. A downhole steam injector comprising:

a solid cylindrical top head having separate orifices extending from an outer surface through the head for oxidant and fuel;

a hollow cylindrical body fastened at a top end to said top head;

orifice means for the passage of water from an outer surface to an inner surface of said body at a location adjacent to the bottom end of said body;

a hollow cylindrical middle sleeve supported at a top end by said top head, said sleeve being axially aligned with and spaced from said body;

means at said top head for the passage of water from the outer to the inner surface of said middle sleeve;

a hollow cylindrical inner sleeve fastened at a top end to said top head, said inner sleeve being axially aligned with and spaced from said middle sleeve; said inner sleeve having a beveled inner surface at the bottom end;

an annular water injector having an outer surface contiguous with the inner surface of said middle sleeve and an inner surface conforming to and affixed to the beveled end of said inner sleeve, said injector having longitudinal water passages extending between opposed end surfaces;

an elongated hollow structure axially aligned with said sleeves extending from the bottom end of said middle sleeve;

a cylindrical bottom head providing a water-tight seal between the bottom end of said body and the outer surface of said hollow structure.

8. The downhole steam injector of claim 7 wherein the outer surface of said annular water injector contains a plurality of spaced longitudinal grooves which form the water passages.

9. A downhole steam injector comprising:

a solid cylindrical top head having opposed outer and inner end surfaces;

a fuel orifice extending from said outer surface to an end at an inner location;

an oxidant orifice extending from said outer surface to said inner surface, a straight portion of said oxidant orifice passing adjacent the inner location and intersecting said inner surface; and a passage orifice extending between the inner location of said fuel orifice and said straight portion of said oxidant orifice, the axis of said passage orifice being normal to the axis of said straight portion;

a hollow cylindrical body fastened at a top end to said top head;

orifice means for the passage of water from an outer surface to an inner surface of said body at a location adjacent the bottom end of said body;

a hollow cylindrical middle sleeve supported at a top end by said top head, said sleeve being axially aligned with and spaced from said body;

means at said top head for the passage of water from the outer to the inner surface of said middle sleeve;

a hollow cylindrical inner sleeve fastened at a top end to said top head, said inner sleeve being axially aligned with and spaced from said middle sleeve, said sleeve encircling said oxidant orifice on said top head;

an annular water injector fastened at the bottom end of said inner sleeve and having an outer surface contiguous with an inside surface of said middle sleeve, said injector having longitudinal water passages extending between opposed end surfaces;

an elongated hollow structure axially aligned with said sleeves extending from the bottom end of said middle sleeve;

a cylindrical bottom head providing a water-tight seal between the bottom end of said body and the outer surface of said hollow structure.

10. A downhole steam injector comprising:

a cylindrical body having a top end, a bottom end, opposed outer and inner side surfaces and a water orifice extending secantly from said outer surface to inner surface at said lower end;

a solid cylindrical top head comprising opposed outer and inner end surfaces; a first side portion having an outer diameter as large as the diameter of said outer side surface of said body, an inwardly extending shoulder portion, and a second side portion having an outer diameter smaller than the diameter of said inner side surface of said body and longitudinal grooves extending from said inner end surface;

a fuel orifice extending from said outer surface to an end at an inner location;

an oxidant orifice extending from said outer surface to said inner end surface, a straight portion of said oxidant orifice passing adjacent the inner location and intersecting said inner surface; and a passage orifice connecting the inner location of said fuel orifice and said straight portion of said oxidant orifice, the axis of said passage orifice being normal to the axis of said straight portion;

a hollow cylindrical middle sleeve having top and bottom ends, an outer diameter less than the diameter of the inner side surface of said body, the inner surface of said sleeve forming a tight, sliding fit at the top end over the grooves of the second side portion of said top head;

a hollow reducer sleeve having a large end of equal size as and fastened to the bottom end of said middle sleeve, and a small end of reduced diameter, the length of said middle sleeve and said reducer sleeve being less than the length of said body;

an outlet pipe having a diameter of equal size as the small end of said reducer sleeve, a top end fastened to the small end, and a bottom end extending past the bottom end of said body;

a cylindrical bottom head having an orifice of diameter equal the outer diameter of said outlet pipe extending between opposed inner and outer end surfaces, said pipe extending through said orifice, the bottom end of said body being fastened to the inner end surface of said bottom head;

an inner sleeve of shorter length than said middle sleeve having an outer diameter smaller than the diameter of the inner surface of said middle sleeve, a top end fastened to the inner end surface of said top head and a beveled inner surface at the bottom end;

an annular water injector having a longitudinally grooved outer surface contiguous with the inner surface of said middle sleeve and an inner surface conforming to and affixed to the beveled end of said inner sleeve; and means for injecting water into the water orifice at the outer surface of said body, whereby water flows up the chamber formed by the inner surface of the bottom head, inner surface of the body and the outer surface of the outlet pipe, reducer sleeve and middle sleeve to the shoulder of said top head, through the grooves in the second side portion of the top head, down the chamber formed by the inner surface of the middle sleeve and the outer surface of said inner sleeve and into the combustion chamber through the grooves in the water injector.

* * * * *